US008794544B2

(12) United States Patent
Melton et al.

(10) Patent No.: US 8,794,544 B2
(45) Date of Patent: Aug. 5, 2014

(54) COMBUSTOR NOZZLE AND METHOD FOR MODIFYING THE COMBUSTOR NOZZLE

(75) Inventors: Patrick Benedict Melton, Horse Shoe, NC (US); Scott Robert Simmons, Simpsonville, SC (US); Russell DeForest, Simpsonville, SC (US); Donald Mark Bailey, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 319 days.

(21) Appl. No.: 13/153,504

(22) Filed: Jun. 6, 2011

(65) Prior Publication Data

US 2012/0308948 A1 Dec. 6, 2012

(51) Int. Cl.
*B05B 15/00* (2006.01)
*F23R 3/28* (2006.01)
*F23R 3/00* (2006.01)

(52) U.S. Cl.
CPC ..... *F23R 3/283* (2013.01); *F23R 3/002* (2013.01); *F23R 2900/00005* (2013.01)
USPC ..... 239/397.5; 239/533.12; 239/548; 239/592; 60/752; 60/754; 60/755

(58) Field of Classification Search
CPC ..... B05B 1/14; B05B 1/044; F02M 61/166; F02M 61/1853; F23R 3/002
USPC ..... 239/548, 397.5, 533.12, 592; 60/752, 60/754, 755; 222/490; 431/352
See application file for complete search history.

(56) References Cited

U.S. PATENT DOCUMENTS

| | | | | |
|---|---|---|---|---|
| 5,222,357 | A * | 6/1993 | Eddy et al. | 60/800 |
| 6,438,961 | B2 * | 8/2002 | Tuthill et al. | 60/776 |
| 6,823,677 | B2 * | 11/2004 | Prociw et al. | 60/800 |
| 2004/0040310 | A1 | 3/2004 | Prociw et al. | |
| 2007/0193248 | A1 * | 8/2007 | Bessagnet et al. | 60/39.01 |
| 2010/0064690 | A1 | 3/2010 | Bailey et al. | |
| 2010/0300106 | A1 * | 12/2010 | Edwards et al. | 60/752 |

FOREIGN PATENT DOCUMENTS

EP 0924458 A1 6/1999

OTHER PUBLICATIONS

EP Search Report and Written Opinion dated Dec. 9, 2013, issued in connection with corresponding EP Patent Application No. 12171076.8.

* cited by examiner

*Primary Examiner* — Jason Boeckmann
*Assistant Examiner* — Joel Zhou
(74) *Attorney, Agent, or Firm* — Dority & Manning, PA

(57) ABSTRACT

A combustor nozzle includes a downstream surface having an axial centerline. A plurality of passages extend through the downstream surface and provide fluid communication through the downstream surface. A plurality of slits are included in the downstream surface, and each slit connects to at least two passages. A method for modifying a combustor nozzle includes machining a plurality of slits in a downstream side of a body. The method further includes connecting each slit to at least two passages that pass through the body.

14 Claims, 4 Drawing Sheets

COMBUSTOR NOZZLE AND METHOD FOR MODIFYING THE COMBUSTOR NOZZLE

FIELD OF THE INVENTION

The present invention generally involves a combustor nozzle and a method for modifying the combustor nozzle. In particular, various embodiments of the present invention provide a combustor nozzle with one or more slits in a downstream surface or side to enhance cracking fatigue resistance of the combustor nozzle.

BACKGROUND OF THE INVENTION

Combustors are commonly used to ignite fuel to produce combustion gases having a high temperature and pressure. Combustor nozzles typically include a body that forms a nozzle tip with a downstream surface, and a working fluid and/or fuel is supplied through the nozzle tip to a combustion chamber where the combustion occurs. The temperature difference between the working fluid and fuel on one side of the nozzle tip and the combustion gases on the other side of the nozzle tip creates a substantial thermal gradient across the nozzle tip that may produce cracking or premature failure in the nozzle tip. As a result, the nozzle tip is often forged from metal alloys and may also be coated with a thermal barrier coating to enhance fatigue resistance to cracking. Alternately or in addition, cooling holes or passages may be formed through the nozzle tip to allow a portion of the working fluid and/or fuel to pass through the nozzle tip to cool the downstream surface and reduce the temperature difference across the nozzle tip.

The holes or passages may be machined into the nozzle tip using various methods known in the art. For example, electron discharge machining (EDM) may be used to melt the forged metal alloy to create the holes or passages. However, the high temperatures associated with the EDM process leaves a recast layer inside the holes or passages, and the recast layer is typically substantially less resistant to fatigue cracking than the original forged metal alloy. In addition, holes and passages that are angled with respect to an axial centerline of the nozzle tip to enhance cooling to the nozzle tip may result in unsupported portions of the nozzle tip that are more susceptible to fatigue cracking. Although in many cases, the additional cracking caused by the recast layer and/or unsupported portions is merely cosmetic, severe cracking may lead to material loss from the nozzle tip and possible downstream damage. Therefore, an improved combustor nozzle and/or method for modifying the combustor nozzle that enhances resistance to fatigue cracking would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor nozzle that includes a downstream surface having an axial centerline. A plurality of passages extend through the downstream surface and provide fluid communication through the downstream surface. A plurality of slits are included in the downstream surface, and each slit connects to at least two passages.

Another embodiment of the present invention is a combustor nozzle that includes a body having an upstream side and a downstream side. A plurality of passages extend through the body and provide fluid communication from the upstream side to the downstream side. A plurality of slits are included in the downstream side, and each slit connects to at least two passages.

The present invention may also include a method for modifying a combustor nozzle that includes machining a plurality of slits in a downstream side of a body. The method further includes connecting each slit to at least two passages that pass through the body.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
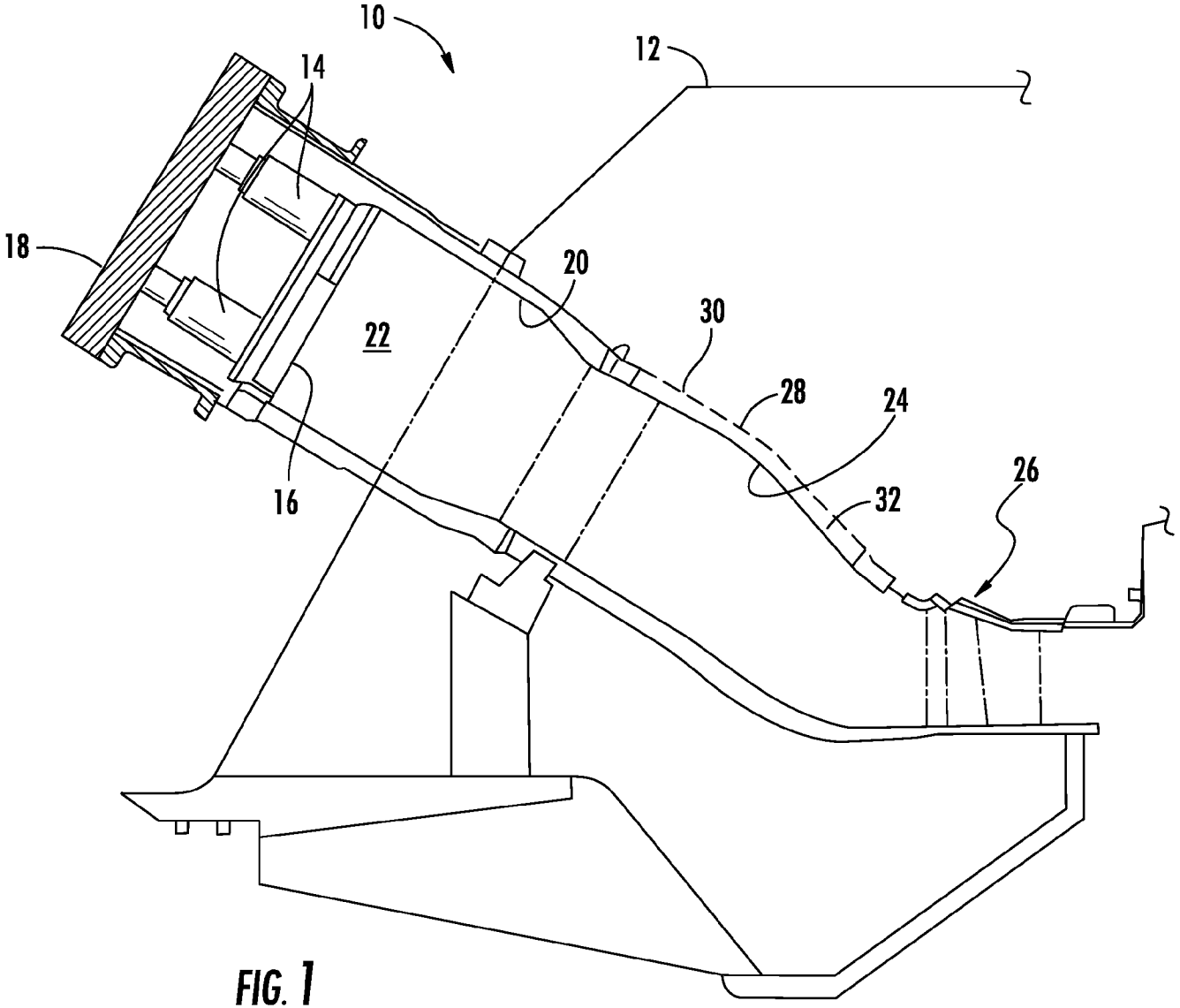
FIG. 1 is a simplified cross-section view of an exemplary combustor.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a combustor nozzle and a method for modifying the combustor nozzle that enhances resistance to fatigue cracking of the nozzle. The enhanced resistance to fatigue cracking may be achieved by one or more features or characteristics of the various embodiments of the present invention. For example, the combustor nozzle may include a plurality of passages through a body or a downstream surface of the combustor nozzle, and one or more slits may connect to at least two passages to provide stress relief in the body or downstream surface. In particular embodiments, the slits may be straight or curved and may extend circumferentially or radially between the passages. Theoretical thermal mapping may be used to predict the location of potential cracks and thus allow precise placement of the slits in particular nozzles to reduce high thermal stresses and enhance cracking fatigue resistance of the combustor nozzle. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section view of an exemplary combustor 10, such as would be included in a gas turbine. A casing 12 may surround the combustor 10 to contain the compressed working fluid flowing to the combustor 10. As shown, the combustor 10 may include one or more nozzles 14 radially arranged between a cap 16 and an end cover 18. Various embodiments of the combustor 10 may include different numbers and arrangements of nozzles 14. The cap 16 and a liner 20 generally surround and define a combustion chamber 22 located downstream from the nozzles 14, and a transition piece 24 downstream from the liner 20 connects the combustion chamber 22 to a turbine inlet 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

An impingement sleeve 28 with flow holes 30 may surround the transition piece 24 to define an annular passage 32 between the impingement sleeve 28 and the transition piece 24. The compressed working fluid may pass through the flow holes 30 in the impingement sleeve 28 to flow through the annular passage 32 to provide convective cooling to the transition piece 24 and liner 20. When the compressed working fluid reaches the end cover 18, the compressed working fluid reverses direction to flow through the one or more nozzles 14 where it mixes with fuel before igniting in the combustion chamber 22 to produce combustion gases having a high temperature and pressure.

Figure 2:
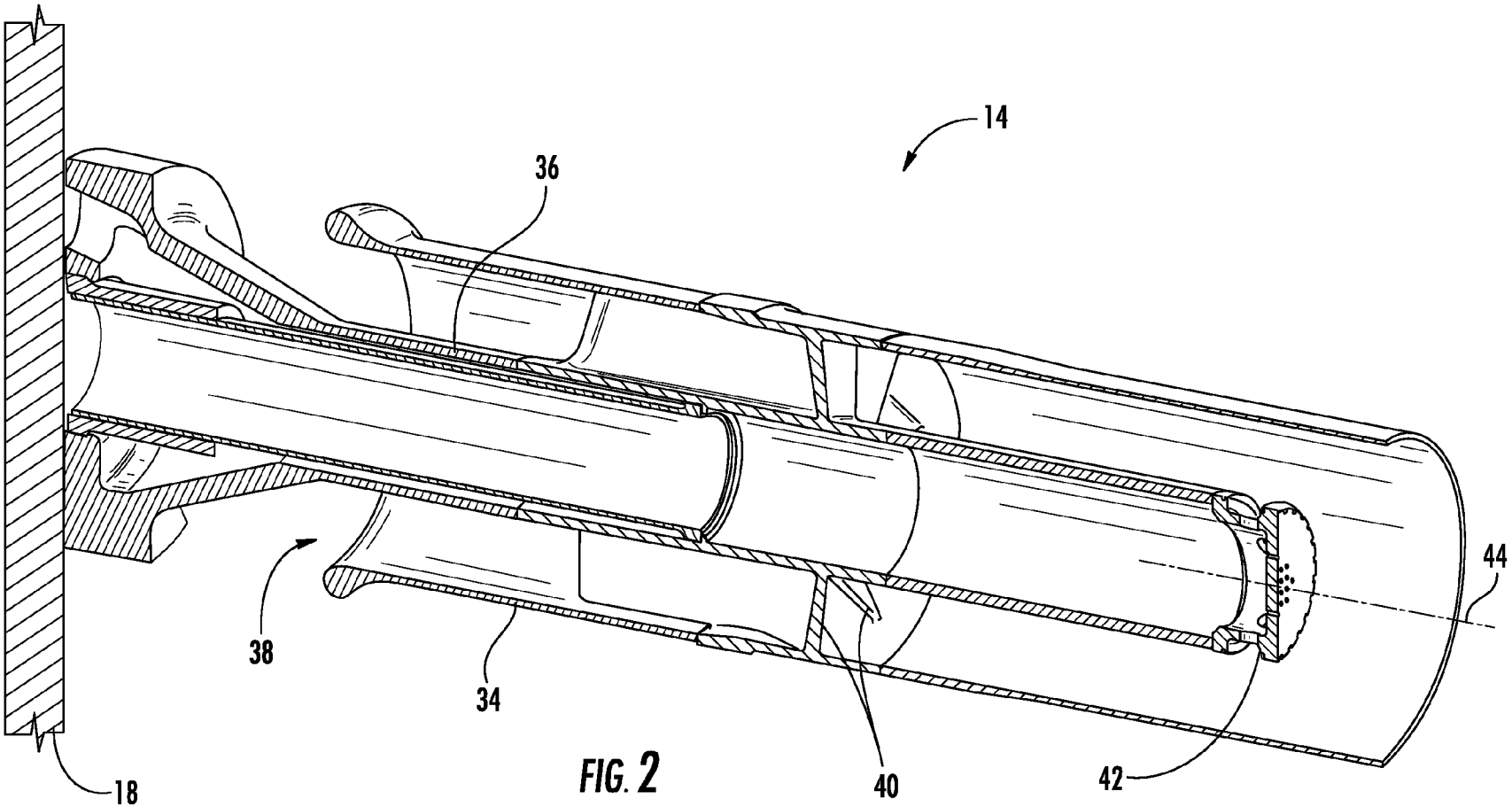
FIG. 2 is a cross-sectional perspective view of an exemplary combustor nozzle shown in FIG. 1.

FIG. 2 provides a cross-sectional perspective view of an exemplary nozzle 14 shown in FIG. 1. As shown, the nozzle 14 may comprise a shroud 34 that circumferentially surrounds at least a portion of a center body 36 to define an annular passage 38 between the shroud 34 and the center body 36. At least a portion of the working fluid may enter the nozzle 14 through the annular passage 38, and one or more swirler vanes 40 between the shroud 34 and the center body 36 may impart a tangential velocity to the compressed working fluid flowing through the nozzle 14. The center body 36 may extend axially from the end cover 18 to a nozzle tip 42, and the nozzle tip 42 may be axially aligned with or parallel to an axial centerline 44 of the nozzle 14. In this manner, the center body 36 provides fluid communication from the end cover 18, through the center body 36, and out of the nozzle tip 42.

Figure 3:
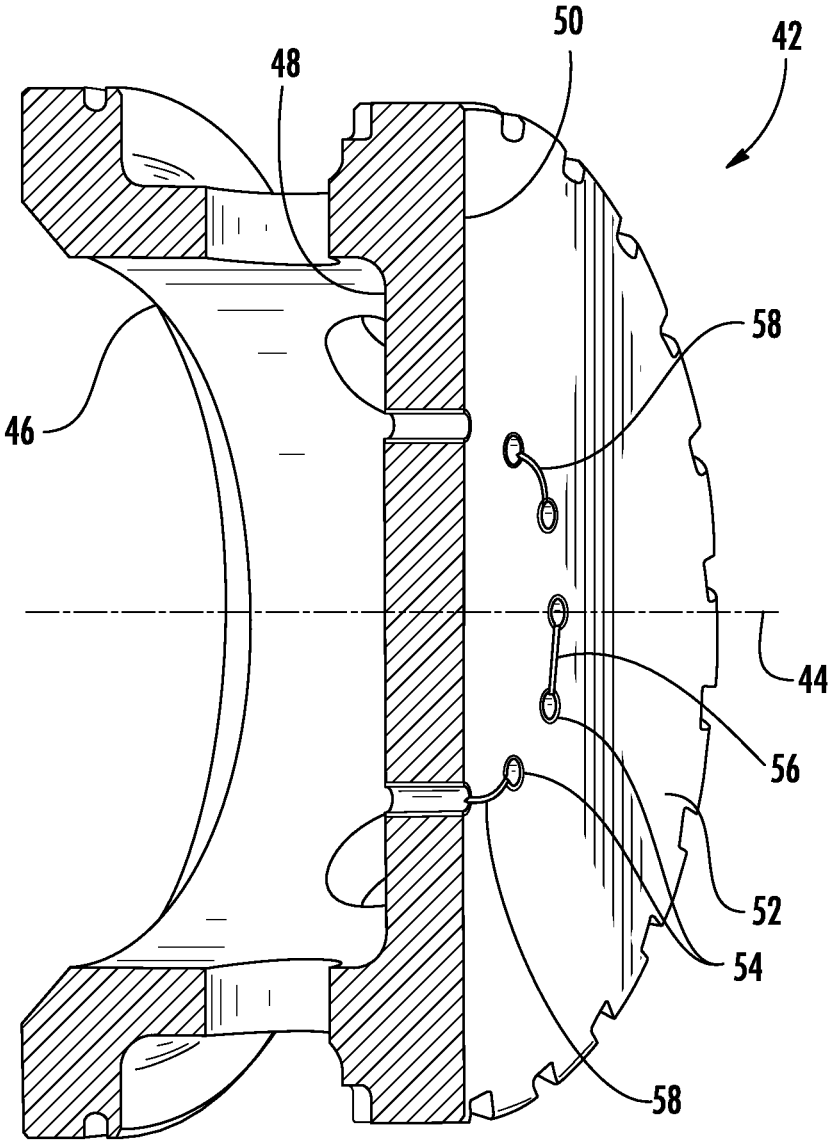
FIG. 3 is an enlarged perspective cross-section view of an exemplary nozzle tip shown in FIG. 2 modified according to a first embodiment of the present invention.

FIG. 3 provides an enlarged perspective cross-section view of an exemplary nozzle tip 42 shown in FIG. 2. As shown, the nozzle tip 42 generally comprises a body 46 having an upstream side 48, a downstream side 50, and a downstream surface 52. The body 46 and/or downstream surface 52 may be cast, forged, or sintered from a metal alloy or powdered metal allow to enhance the fatigue resistance of the nozzle tip 42 proximate to the combustion chamber 22. The nozzle tip 42 may further include a plurality of holes or passages 54 that extend through the body 46 and/or downstream surface 52 to provide fluid communication from the upstream side 48 to the downstream side 50 or through the body 46 and/or downstream surface 52. The holes or passages 54 may be aligned substantially parallel to or angled with respect to the axial centerline 44. In the particular embodiment illustrated in FIG. 3, the holes or passages 54 are aligned substantially parallel to the axial centerline 44. In this manner, the passages 54 allow a fluid, such as a fuel, an oxidant, or a diluent, to flow through the body 46 and/or downstream surface 52 to cool the body 46, the downstream side 50 of the body 46, and/or downstream surface 52.

As shown in FIG. 3, the nozzle tip 42 may include one or more straight slits 56 and/or arcuate slits 58 in the downstream side or surface 50, 52 to relieve thermal stresses in the surface 52 of the body 46. Each slit 56, 58 may be machined into the downstream side or surface 50, 52 using conventional methods known in the art. For example, the slits 56, 58 may be formed by grinding or using a laser, water jet, or electron discharge machining (EDM) process to melt the forged metal alloy to connect each slit 56, 58 to a pair of passages 54. The specific number, location, width, depth, and shape of each slit 56, 58 will depend on the particular geometry of the nozzle tip 42 and the anticipated thermal stresses in the body 46 or downstream surface 52. For example, in the particular embodiment shown in FIG. 3, each slit 56, 58 extends circumferentially in the downstream side or surface 50, 52 and connects to at least two passages 54. The width of each slit 56, 58 may vary between approximately 5 mils and 50 mils, and each slit 56, 58 may extend axially completely through the downstream surface 52 to the upstream side 48. In particular embodiments, 3 or 4 slits 56, 58 spaced equidistantly around the downstream surface 52 may provide adequate stress relief, while in other particular embodiments, each passage 54 may be connected to at least one slit 56, 58.

Figure 4:
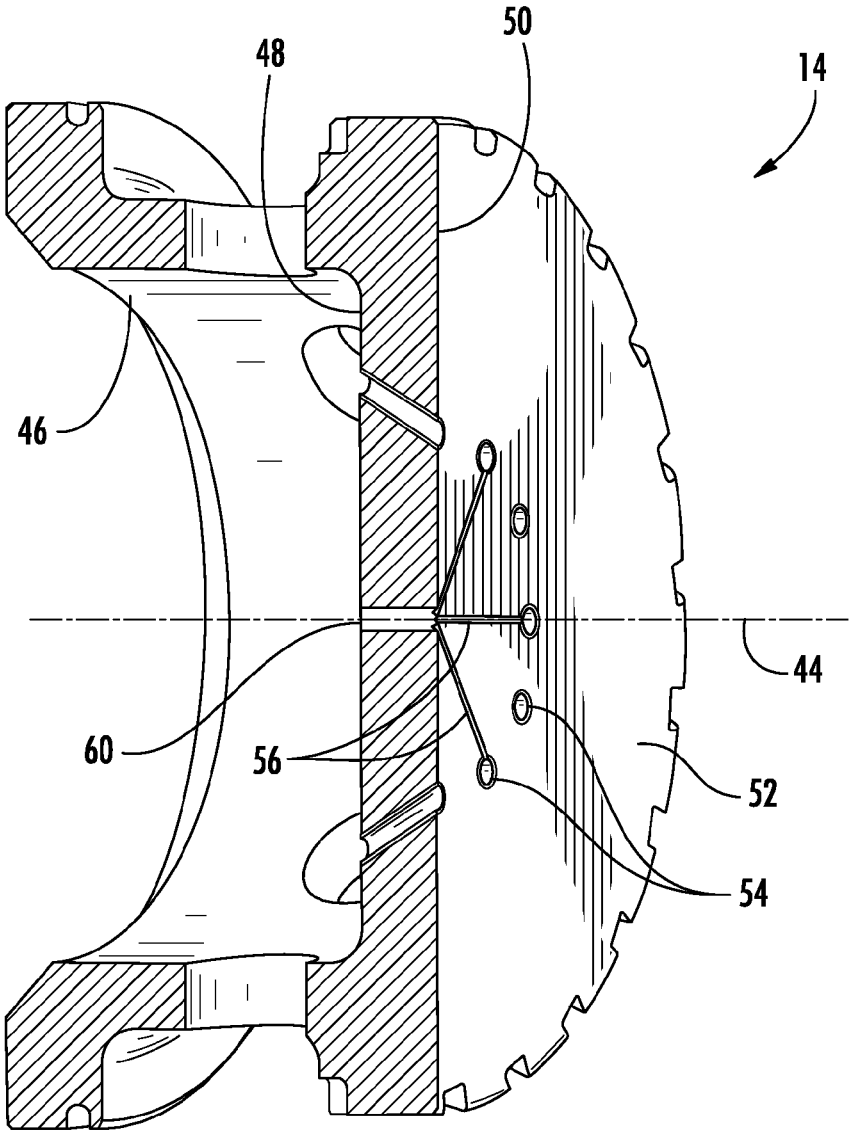
FIG. 4 is an enlarged perspective cross-section view of an exemplary nozzle tip shown in FIG. 2 modified according to a second embodiment of the present invention.

FIG. 4 provides an enlarged perspective cross-section view of another exemplary nozzle tip 42 shown in FIG. 2. As shown, the nozzle tip 42 again generally comprises a body 46, an upstream side 48, a downstream side 50, a downstream surface 52, and a plurality passages 54 as previously described with respect to the nozzle tip 42 shown in FIG. 3. In the particular embodiment illustrated in FIG. 4, the passages 54 are generally angled radially and/or circumferentially with respect to the axial centerline 44 with a center passage 60 aligned substantially coincident with the axial centerline 44. The angled passages 54 enhance cooling to the downstream side or surface 50, 52 by swirling the fluid flowing through the passages 54, 60.

Figure 5:
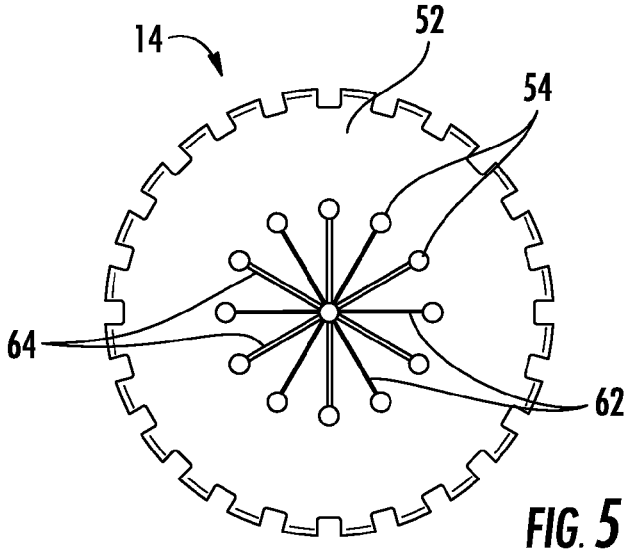
FIG. 5 is a top plan view of the nozzle tip shown in FIG. 4.

In the embodiment shown in FIG. 4, the plurality of straight slits 56 extend radially in the downstream side or surface 50, 52 between the passages 54, 60, and, as shown most clearly in FIG. 5, the width and depth of the straight slits 56 varies. Specifically, first slits 62 are narrow and do not extend completely through the body 46, while second slits 64 are slightly wider and extend axially from the downstream surface 52 to the upstream side 48. In this manner, the first slits 62 allow less flow through the body 46 and more flow through the passages 54, 60. In addition, the amount of machining and removal of forged metal alloy from the downstream surface 52 may be reduced while providing adequate stress relief to the body 46 and/or downstream surface 52.

The embodiments shown in FIGS. 3 and 4 may be manufactured for use in new or existing nozzles 14, or existing nozzle tips 42 may be modified to achieve the desired stress relief. A method for modifying the combustor nozzle 14 includes machining the slits 56, 58 in the downstream side or surface 50, 52 of the body 46, as previously described, and connecting each slit 56, 58 to at least two passages 54 that pass through the body 46. Depending on the particular design needs, the method may include machining straight or arcuate slits 56, 58 and/or aligning the slits 56, 58 circumferentially and/or radially in the downstream side or surface 50, 52. If desired, the method may include connecting each passage 54, 60 to at least one slit 56, 58 and/or machining at least one slit 56, 58 completely through the body 46.

One of ordinary skill in the art will readily appreciate that the strategic location of the slits 56, 58 in the various embodiments contributes to increased durability of the nozzle 14 with minimal cost and impact on the nozzle 14 performance. The slits 56, 58 effectively function as pre-designed or built in cracks in the nozzle tip 42 that extend the effective life of the nozzle 14 by enhancing the crack fatigue resistance in the nozzle tip 42 and thus the overall reliability of the combustor 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor fuel nozzle, comprising:

a. a center body having an upstream end axially separated from a downstream end;

b. a nozzle tip that extends radially and circumferentially across the downstream end of the center body, the nozzle tip including a downstream surface, the nozzle tip having an axial centerline;

c. a plurality of passages extending through the downstream surface of the nozzle tip and circumferentially arranged around the downstream surface, wherein the plurality of passages provide fluid communication through the downstream surface; and d. a plurality of slits defined in the downstream surface, wherein each slit extends circumferentially to connect at least two circumferentially adjacent passages of the plurality of passages.

2. The combustor nozzle as in claim 1, wherein each passage is aligned substantially parallel to the axial centerline of the downstream surface.

3. The combustor nozzle as in claim 1, wherein each passage is connected to at least one slit.

4. The combustor nozzle as in claim 1, wherein at least one slit extends circumferentially in the downstream surface between at least two passages.

5. The combustor nozzle as in claim 1, wherein at least one slit extends radially in the downstream surface between at least two passages.

6. The combustor nozzle as in claim 1, wherein at least one slit is arcuate between at least two passages.

7. The combustor nozzle as in claim 1, further comprising an upstream side opposed to the downstream surface, and wherein the plurality of slits extend axially from the downstream surface to the upstream side.

8. A combustor fuel nozzle, comprising:

a. a center body having an upstream end axially separated from a downstream end;

b. an outer shroud that extends circumferentially around a portion of the center body;

c. a plurality of turning vanes that extend between an outer surface of the center body and the outer shroud;

d. a nozzle tip that extends radially and circumferentially across the downstream end of the center body, the nozzle tip having an upstream side and a downstream side;

e. a plurality of passages extending through the nozzle tip and circumferentially arranged around the downstream surface, wherein the plurality of passages provide fluid communication from the upstream side to the downstream side; and f. a plurality of slits defined in the downstream side, wherein each slit extends circumferentially to connect at least two circumferentially adjacent passages of the plurality of passages.

9. The combustor nozzle as in claim 8, wherein the plurality of passages are aligned parallel to an axial centerline of the body.

10. The combustor nozzle as in claim 8, wherein each passage is connected to at least one slit.

11. The combustor nozzle as in claim 8, wherein at least one slit extends circumferentially in the downstream side between at least two passages.

12. The combustor nozzle as in claim 8, wherein at least one slit extends radially in the downstream side between at least two passages.

13. The combustor nozzle as in claim 8, wherein at least one slit is arcuate between at least two passages.

14. The combustor nozzle as in claim 8, wherein at least one slit extends axially from the downstream side to the upstream side.

* * * * *